US005570429A

United States Patent [19]

Paddock

[11] Patent Number: 5,570,429

[45] Date of Patent: Oct. 29, 1996

[54] AUDIO TRANSDUCER WITH FLEXIBLE FOAM ENCLOSURE

[75] Inventor: Paul W. Paddock, McMinnville, Oreg.

[73] Assignee: Lineaum Corporation, Portland, Oreg.

[21] Appl. No.: 384,380

[22] Filed: Feb. 3, 1995

Related U.S. Application Data

[63] Continuation of Ser. No. 986,803, Dec. 8, 1992, abandoned.

[51] Int. Cl.[6] ..... H04R 25/00

[52] U.S. Cl. ..... 381/202; 381/193

[58] Field of Search ..... 381/188, 192, 381/193, 194, 197, 199, 202, 204, 182, 186; 181/153, 166, 169, 171, 172, 173

[56] References Cited

U.S. PATENT DOCUMENTS

| | | | |
|---|---|---|---|
| 1,821,469 | 9/1931 | Hicks | 181/169 |
| 3,612,783 | 10/1971 | Schneider | 381/204 |
| 4,584,439 | 4/1986 | Paddock | 179/115.5 |
| 4,903,308 | 2/1990 | Paddock et al. | 381/202 |
| 4,939,783 | 7/1990 | Dunning | 381/188 |
| 5,127,060 | 6/1992 | Paddock | 381/197 |
| 5,198,624 | 3/1993 | Paddock et al. | 181/166 |

FOREIGN PATENT DOCUMENTS

| | | | |
|---|---|---|---|
| 0159831 | 6/1983 | Germany | 181/171 |
| 8903160 | 4/1989 | WIPO | 381/202 |

*Primary Examiner*—Curtis Kuntz
*Assistant Examiner*—Huyen D. Le
*Attorney, Agent, or Firm*—Klarquist Sparkman Campbell Leigh & Whinston, LLP

[57] ABSTRACT

An audio transducer includes a rigid base plate and a flexible foam element attached to the plate. The foam element has a "B" shaped cross section, with a plastic film diaphragm conformally attached to the dual semi-cylindrical front surface of the foam element. The foam element defines a large circular bore for receiving a magnet assembly attached to the plate, with a electrical coil attached to the diaphragm and received within a gap defined within the magnet assembly. The plate and diaphragm are sealed to the foam element to provide an environmentally sealed chamber within the bore.

28 Claims, 3 Drawing Sheets

AUDIO TRANSDUCER WITH FLEXIBLE FOAM ENCLOSURE

This application is a continuation of application Ser. No 07/986,803, filed on Dec. 8, 1992, now abandoned.

TECHNICAL FIELD

This invention generally relates to audio transducers. More particularly, the invention relates to improvements in the design of a transducer having a flexible diaphragm.

BACKGROUND OF THE ART

U.S. Pat. Nos. 4,584,439, 4,903,308, 5,127,060, and pending U.S. patent applications Ser. Nos. 07/436,914 filed Nov. 14, 1989, now issued as U.S. Pat. No. 5,198,624; No. 07/730,172 filed Jul. 12, 1991, now issued as U.S. Pat. No. 5,230,021; No. 07/916,038 filed Jul. 17, 1992, No. 07/882,144 filed May 11, 1992, and No. 07/962,988, filed Oct. 15, 1992, are incorporated herein by reference. These references disclose variations and refinements of audio transducers having flexible diaphragms that can be generally described as "cylindrical" in the broadest sense of the term. That is, the diaphragm is defined by a two dimensional cross-sectional profile that is projected on an axis to form a three-dimensional diaphragm having a constant cross section. Typically, this profile is in the form of a "figure-eight" or a "figure-three" shape having two adjacent parallel semi-cylindrical lobes facing forward toward the listener.

In operation, these disclosed transducers generate sound by a "rolling motion" in which an electromagnetic coil attached to the diaphragm interacts with a fixed magnetic field to move in a direction perpendicular to the vertical axis of projection of the diaphragm, oscillating toward and away from the listener in a forward and rearward direction. While the transducers of the above-referenced applications and patents are quite effective, there remains a need for additional improvements to improve performance and reduce manufacturing costs.

Existing transducers have variations in efficiency over the useful frequency range. One variation may be generated by internal reflections of acoustic waves within the diaphragm at the top and bottom free edges of the diaphragm. A loss of efficiency may also occur at the top and bottom free edges of the diaphragm; acoustic pressure generated at the front of the diaphragm may be dissipated by the flow of some air over the edges of the diaphragm to the low-pressure region behind the diaphragm.

A further need in the prior art is to provide a simplified means for centering or positioning the diaphragm relative to the magnet structure during manufacturing. In addition, there is a need to reduce manufacturing costs by reducing the quantity and cost of components, and to reduce the need for precision and skilled labor to perform various manufacturing steps. Also, it is desirable to reduce the size and weight of existing transducers.

SUMMARY OF THE INVENTION

The primary object of this invention is to provide an improved transducer having features that independently and in concert overcome the difficulties and shortcoming of the prior art, and which fulfills the aforementioned needs.

This object may be satisfied by providing a transducer having a base plate with a magnet assembly forming a magnet gap, a flexible foam element attached to the base plate and having a "figure-three"-shaped front surface for supporting a similarly shaped flexible diaphragm, which is attached to the foam element. The foam element defines a chamber in which a coil centrally attached to the diaphragm is suspended within the magnet gap. The entire chamber may be sealed to prevent entry of dirt particles.

DETAILED DESCRIPTION OF THE INVENTION

Figure 1:
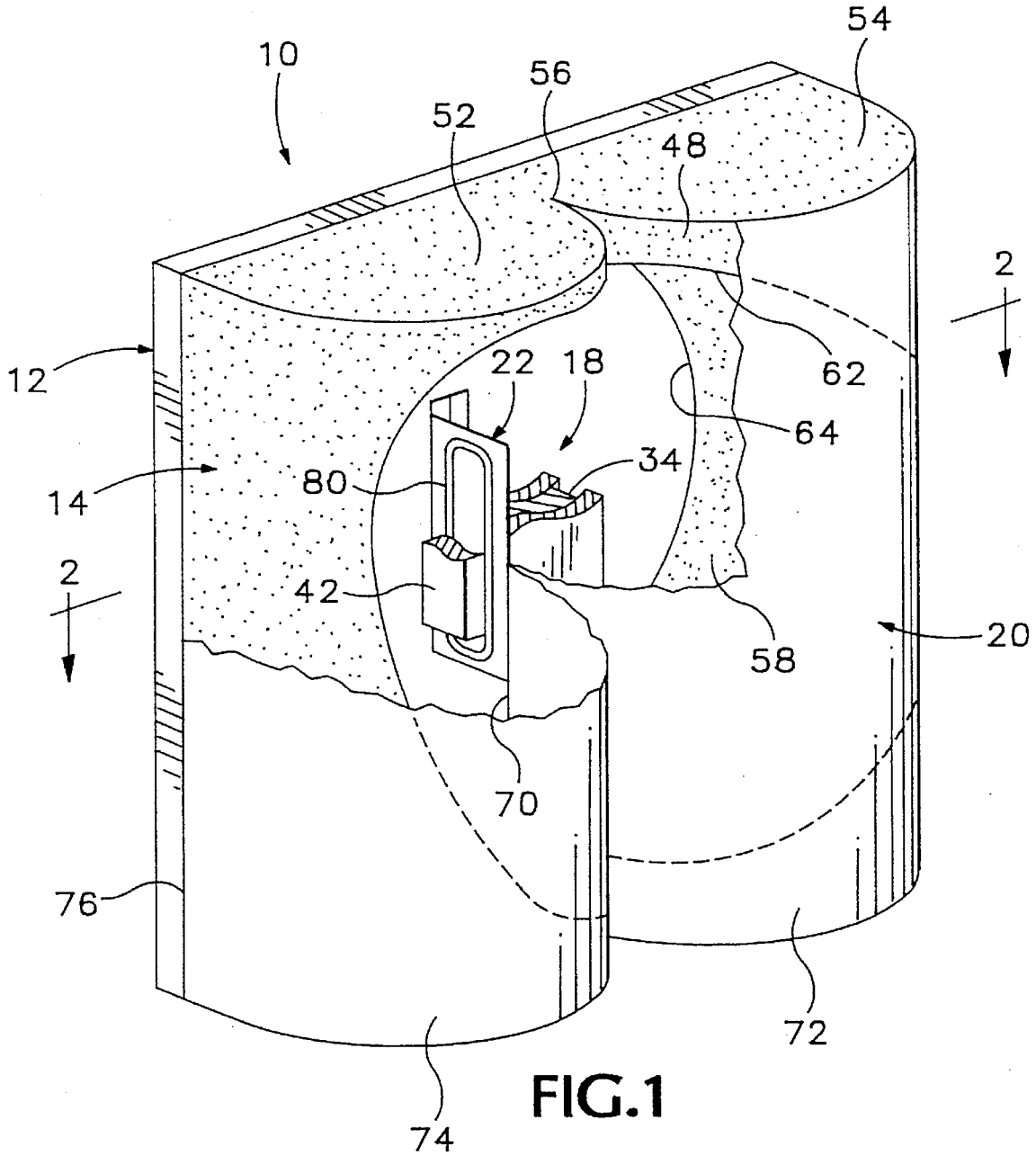
FIG. 1 is a cutaway perspective view of a transducer in accordance with a first embodiment of the present invention.

FIG. 1 illustrates an audio transducer 10 having a rigid base plate 12 to which a flexible foam frame element 14 is attached. A magnet assembly 18 is centrally attached to the plate 12. A flexible cylindrical diaphragm 20 is attached to the front of the foam element 14 to conform thereto. A coil 22 is centrally attached to the diaphragm to be positioned near the magnet assembly 18.

Figure 2:
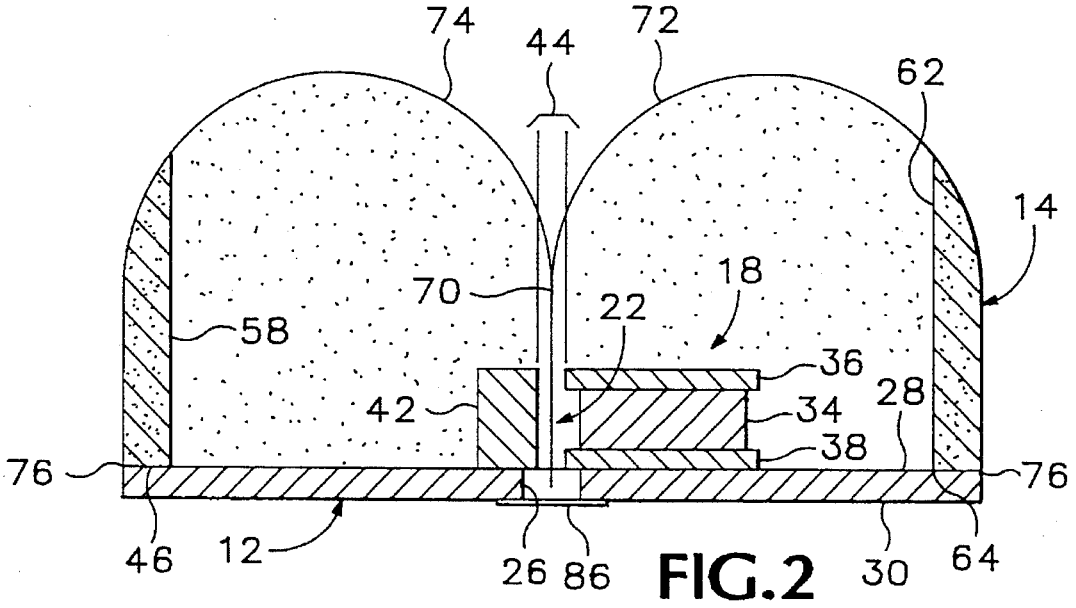
FIG. 2 is a sectional bottom view of the transducer of FIG. 1 taken along line 2—2.

The plate 12 is a rigid metal plate, preferably of aluminum, although steel plate having weak magnetic properties or any other nonmetallic rigid structure may be substituted. The plate defines a rectangular slot 26 parallel to a major edge of the plate and centrally located therein. As shown in FIG. 2, the plate has a front surface 28 and rear surface 30.

The plate 12 need not be a flat sheet, although this is preferred as the lowest cost alternative. The plate may be an extruded rail having perpendicular side flanges for extending forward to capture the foam element 14 or extending rearward away from the foam element. Alternatively, the plate may be a deep drawn cup shape entirely surrounding the periphery of the foam element 14. If desired, for certain applications, the entire transducer 10 may have a circular profile instead of square, with the corners being rounded off. The plate may further include flanges or attachment holes at the rear plane of the speaker, or extending forward beyond the front surface of the diaphragm 20 to provide a recessed or flush mounting in a panel.

As further shown in FIG. 2, the magnet assembly 18 is attached at a central location on the front surface 28 of the plate 12. The magnet assembly includes a magnet 34 having a front pole plate 36 and a rear pole plate 38, with the rear pole plate being adhered directly to the base plate 12. An iron return bar 42 is positioned adjacent the pole plates to form a magnet gap 44. The magnet assembly 18 is positioned so that the magnet gap 44 is centrally registered with the slot 26 in the plate 12. Accordingly, a first magnetic field spans between the front pole plate 36 and a front portion of the return bar 42, while a second magnetic field of opposite direction and polarity spans between a rear portion of the return bar 42 and the rear pole plate 38.

Figure 3:
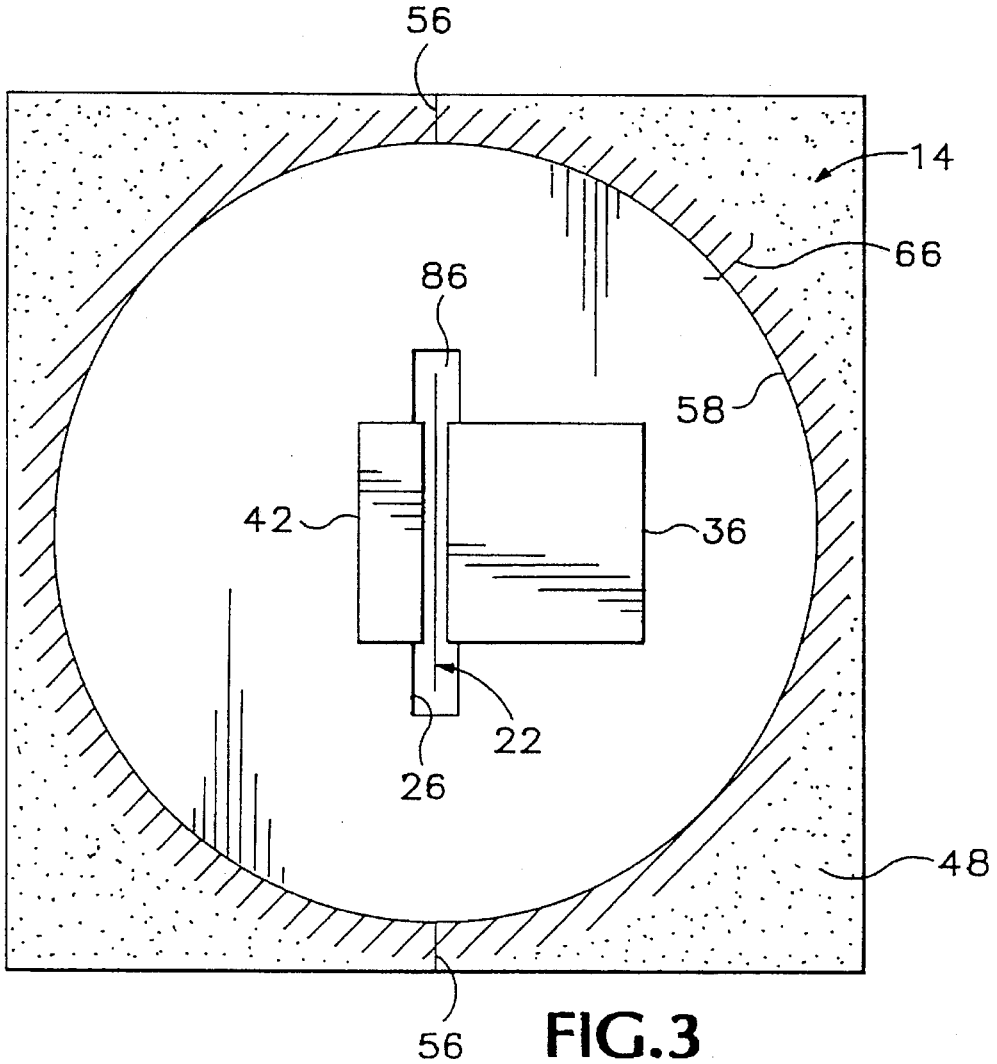
FIG. 3 is a front view of the transducer of FIG. 1 with the diaphragm removed.

The foam frame element 14 has a B-shaped exterior profile as viewed from the top or bottom as shown in FIG. 2. This provides a flat rear surface 46 adhered to and coextensive with the front surface 28 of plate 12. As best shown in FIG. 1, the foam element 14 has a front surface 48 in the shape of two semi-cylindrical lobes 52 and 54, which are positioned side by side in nearly tangential contact to define a groove 56. As shown in FIG. 3, the foam element 14 defines a large circular bore 58 passing entirely through the foam element 14 from front to rear, on an axis perpendicular to the rear surface 46. The bore 58 terminates at a front aperture 62 in the front surface 48, and at a rear aperture 64 in the rear surface 46. The front surface 48 includes a rim portion 66 entirely encompassing and immediately adjacent the front aperture 62, providing a continuous band to which adhesive will be applied. The frame element is preferably formed of a medium-weight, open-cell polyether foam, although a wide variety of flexible materials may potentially be substituted. The element may be molded, extruded, die cut, or hot wire cut, or fabricated by a combination of these processes. Preferably, the foam element 14 is a single integral unit to facilitate simple assembly of the transducer 10, with the groove 56 centrally aligned with the magnet gap 44.

The diaphragm 20, as shown in FIGS. 1 and 2, is a single thin flexible plastic sheet having a central fold 70 that is received within the foam element groove 56, with a pair of curved expanses 72 and 74 conforming to the semi-cylindrical front surface 48 of the foam element 14. Thus, it is apparent that the foam element 14 serves a form function to support and shape the diaphragm 20. The distal edge 76 of each expanse is attached to or near a respective edge of the base plate 12. Consequently, the distal edges 76 are effectively fixed in position so that they do not normally move when the central portion of the diaphragm oscillates. The diaphragm may be adhered to the entire front surface of the foam element 14, although it is only necessary that the diaphragm be adhered to the entire rim portion 66. It is important that the rim portion 66 of the foam element 14 adjacent the front aperture 62 be coupled with the diaphragm so that motion in the central portion of the diaphragm does not cause relative sliding between the diaphragm and the foam element, which would generate unwanted buzzing in the transducer. All diaphragm motion is to be accommodated by flexing of the foam element 14.

Figure 4:
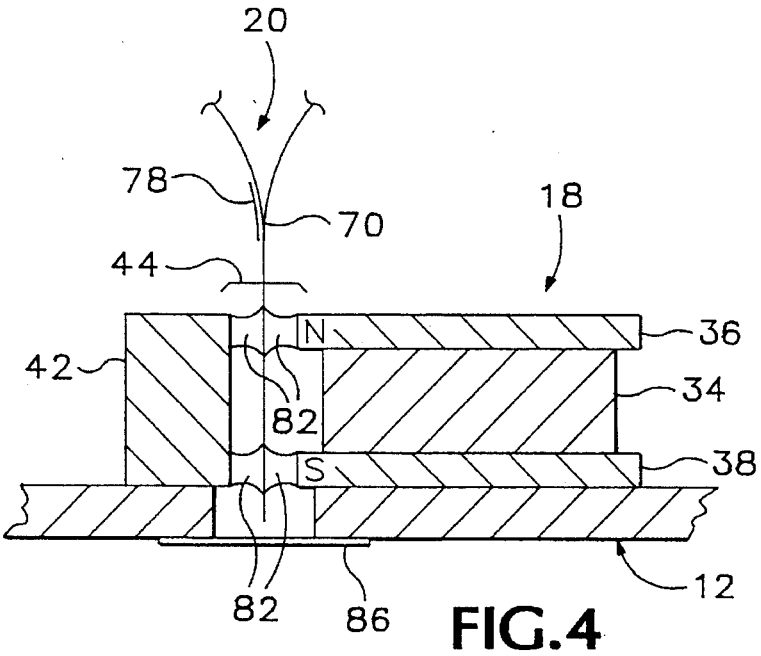
FIG. 4 is an enlarged sectional bottom view of the transducer of FIG. 1.

As best shown in FIG. 4, the coil 22 is attached at one edge to the fold 70 of the diaphragm 20 so that it resides within the magnet gap 44. A strip of tape 78 on one or both sides of the junction between the coil 22 and diaphragm provides secure attachment. As shown in FIG. 1, the coil includes a spiral trace 80 arranged in an oblong racetrack shape to function in the manner disclosed in the art incorporated by reference above. The coil 22 preferably includes a spiral trace on each side for heat dissipation and efficiency.

Oscillation of the coil toward and away from the listener is accommodated by the slot 26 formed in the base plate 12. The slot 26 is sufficiently large to provide clearance of the coil 22. Oscillation is transmitted to the diaphragm 20, which moves relatively freely at the small displacements associated with high frequencies over 2500 Hz. This is due to the flexibility of the foam element 14, particularly because of the thin cross-section of the foam near the groove 56 at the lower and upper portions of the foam element. Additional flexibility may be provided, if necessary, by slitting the diaphragm 20 along the fold 70 at each end thereof, and resealing the slits with a flexible adhesive tape strip (not shown).

As shown in FIG. 4, to further facilitate heat dissipation, efficiency, and accurate centering of the coil 22 within the magnet gap 44, a small quantity of ferrofluid 82 is provided in the magnet gap 44. The ferrofluid 82 contains suspended magnetic particles and wicks into the magnet gap 44 on either side of the coil 22 at positions adjacent the edges of the pole plates 36, 38.

Suitable ferrofluid may be obtained from Ferrofluidics of Nashua, N.H. A viscosity of 200 to 300 centipoids is preferred, although a wide range of viscosities has proven suitable.

Figure 5:
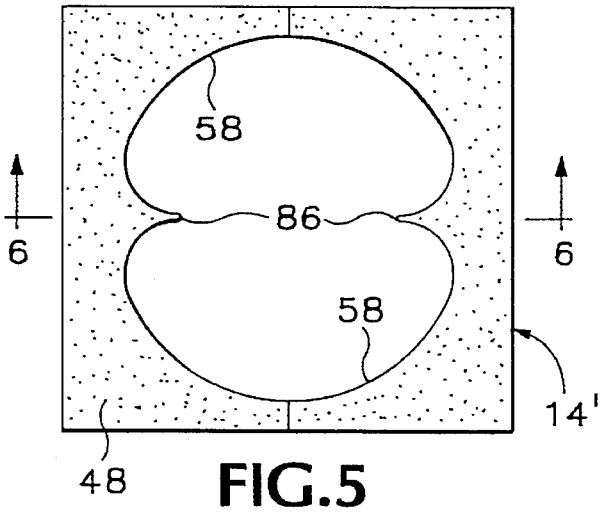
FIG. 5 is a front view of a foam element of an alternative embodiment.
Figure 6:
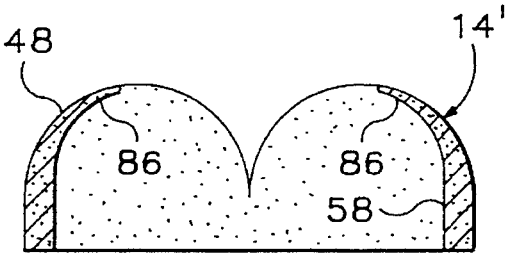
FIG. 6 is a sectional bottom view of the element of claim 5 taken along line 6—6.

FIGS. 5 and 6 show an alternative embodiment of the foam frame element 14 in which a pair of damping fingers 86 extend into the bore 58 along the front surface 48. These are intended to be adhered to the diaphragm 20 to damp any unwanted vibrations or resonances. The shape, size, location, and quantity of the fingers may be adjusted to optimize the performance for a variety of transducer embodiments. It should be further noted that the circular shape of the bore 58 is preferred because its geometry provides a varying width to avoid resonances at particular frequencies. Alternatively, the bore may be formed of an elliptical or other shape, and may have irregular edges.

When assembled, as shown in FIG. 2, the plate 12, frame 14, and diaphragm 20 enclose a chamber 84 in which the coil 22 and magnet assembly 18 reside. The components are adhered together so that particles may not enter the chamber after assembly. A tape strip 86 is adhered to the rear surface of the base plate 12 to cover the slot 26, providing a completely enclosed chamber. This permits the transducer to be completely assembled and sealed before the magnet 34 is magnetized by application of an external magnetic field.

Figure 7:
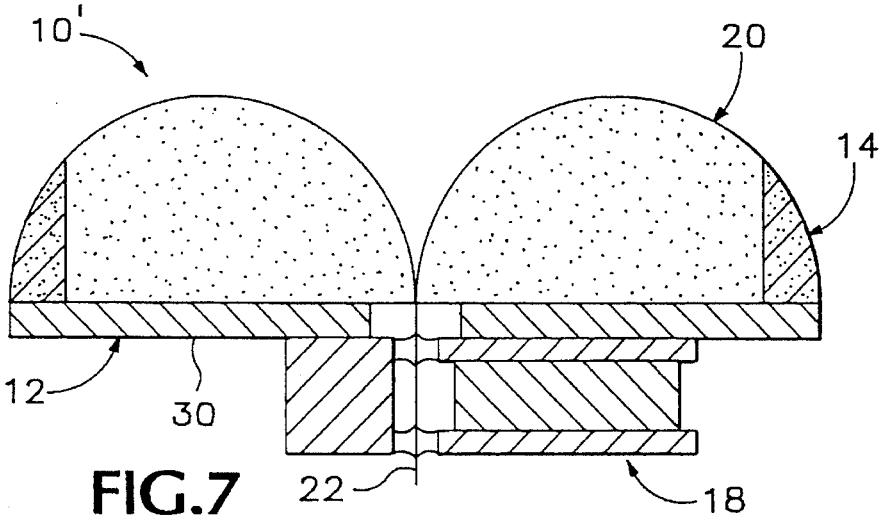
FIG. 7 is a sectional bottom view of a transducer in accordance with a second embodiment of the present invention.

FIG. 7 shows an alternate transducer 10' in which the magnet assembly 18 is attached to the rear surface 30 of the base plate 12. Consequently, the magnet assembly 18 is positioned outside of the sealed chamber 84. A rear enclosure (not shown) may be attached to the base plate to protect and seal the magnet assembly 18 and coil 22.

Although the illustrated embodiments are intended for use as "tweeters" with a low frequency limit of about 2500–3000 Hz and a high frequency limit of 20–30 kHz, the disclosed structures may be applied in transducers having different frequency limits. The preferred embodiment has a square profile between two to three inches on a side. Smaller transducers one inch on a side may be used as "super tweeters" with a useful range above 5 kHz. Such small sizes also enjoy the added benefit of improved dispersion, functioning effectively as a point source without an appreciable reduction in sound pressure levels 90 degrees off axis.

Having illustrated and described the principles of my invention by what is presently a preferred embodiment, it should be apparent to those persons skilled in the art that the illustrated embodiment may be modified without departing from such principles. I claim as my invention not only the illustrated embodiment, but all such modifications, variations and equivalents thereof as fall within the true spirit and scope of the following claims.

I claim:

1. An audio transducer comprising:

a rigid frame;

a magnetic assembly attached to the frame and defining a magnet gap;

a flexible sheet diaphragm having a pair of curved expanses;

a coil attached to the diaphragm, at least a portion of the coil being suspended within the magnet gap such that current flowing through the coil generates motion of the coil and at least a portion of the diaphragm relative to the frame; and a flexible diaphragm form attached to the frame and having a form function to support and shape the flexible diaphragm, the diaphragm form having a front curvilinear surface including a middle portion from which said curved expanses extend and to which the diaphragm is attached so that the diaphragm conforms to the curvilinear surface.

2. The apparatus of claim 1 wherein the diaphragm form is formed at least in part of open cell foam.

3. The apparatus of claim 1 wherein the front surface comprises a pair of adjacent, convexly curved cylindrical portions.

4. The apparatus of claim 1 wherein the diaphragm form has a B-shaped cross sectional profile.

5. The apparatus of claim 1 wherein after conforming to the diaphragm form the diaphragm includes a pair of adjacent curvilinear portions joined at a fold therebetween.

6. The apparatus of claim 5 wherein the diaphragm form defines a groove at the middle portion and the fold is received within the groove.

7. The apparatus of claim 6 wherein the groove is complanar with the magnet gap.

8. An audio transducer comprising:

a rigid frame;

a magnetic assembly supported by the frame and defining a magnet gap;

a flexible sheet diaphragm;

a coil attached to the diaphragm, at least a portion of the coil being suspended within the magnet gap such that current flowing through the coil generates motion of the coil and diaphragm relative to the frame; and a flexible diaphragm form attached to the frame and having a form function to support and shape the flexible diaphragm, the diaphragm form having a front curvilinear surface, portions of which lie in respective curvilinear planes and to which the diaphragm is attached thereby forming tangential curvilinear lobes.

9. An audio transducer comprising:

a frame;

a flexible sheet diaphragm;

an electrically actuated drive mechanism cooperative with the diaphragm to move same in a substantially planar manner; and a contoured diaphragm form having at least two curvilinear, adjacent lobes to which the diaphragm is affixed, the diaphragm form serving a form function to support and shape the diaphragm into a curvilinear configuration.

10. The transducer of claim 9 wherein the diaphragm is formed from a single sheet of material having a central fold.

11. The transducer of claim 9 wherein the drive mechanism includes a coil sandwiched between the respective planar surface portions of the lobes and a magnet assembly supported by the frame, which defines a magnetic gap wherein the coil is located.

12. An audio transducer, comprising:

(a) a frame;

(b) a diaphragm support member having a rear surface attached to the frame, and a curvilinear front surface shaped as two tangential semi-cylinders, the support member further defining an opening extending from the front surface to the rear surface thereof;

(c) a diaphragm substantially covering the front surface and covering the opening the support member serving a form function to support and configure the diaphragm; and (d) an electromagnetic transducer that movably responds to electrical signals that is connected to the diaphragm for moving the diaphragm to produce sound.

13. The audio transducer of claim 12 wherein the opening is substantially circular.

14. The audio transducer of claim 12 wherein the opening is substantially rectangular.

15. The audio transducer of claim 12 wherein the support member includes an end surface having a substantially B-shaped profile.

16. The audio transducer of claim 12 wherein the diaphragm, when attached to the support member, is shaped as two substantially semi-tubes tangentially joined.

17. The audio transducer of claim 12 wherein the electromechanical transducer comprises a magnetic assembly defining a magnet gap, and a coil that is at least partially suspended in the gap and that is attached to the diaphragm so that current flowing in the coil causes the coil, and thus the diaphragm, to move.

18. The audio transducer of claim 12 wherein the diaphragm is adhered to the front surface of the support member proximate the opening.

19. The audio transducer of claim 12 further comprising at least one damping finger located within the opening.

20. The audio transducer of claim 12 further comprising at least one damping finger integrally formed of the support member.

21. The audio transducer of claim 12 wherein the support member defines a groove and the diaphragm includes a fold that is received in the groove when the diaphragm is attached to the support member.

22. An audio transducer, comprising:

(a) a diaphragm support member having a substantially planar rear surface that defines a rear aperture and a curved front surface that defines a front aperture, an opening extending between the front and rear apertures, wherein the front surface has a shape resembling two substantially tangential semi-cylindrical lobes;

(b) a diaphragm attached to the support member along the front surface and covering the front aperture wherein the support member serves a form function to support and shape the diaphragm; and (c) an electromagnetic transducer attached to the diaphragm for moving the diaphragm in response to electrical signals.

23. The audio transducer of claim 22 wherein the support member is foam.

24. The audio transducer of claim 22 further comprising damping fingers extending into the opening and in contact with the diaphragm.

25. The audio transducer of claim 22 wherein the diaphragm is a sheet having a central fold.

26. The audio transducer of claim 22 wherein the support member includes a groove between the semi-cylindrical lobes and the diaphragm is a sheet having a fold and the fold is located in the groove when the diaphragm is connected to the support member.

27. The audio transducer of claim 22 further comprising a rim portion circumscribing the front aperture and wherein the diaphragm is attached to the rim portion.

28. The audio transducer of claim 22 wherein the electromechanical transducer comprises a magnetic assembly defining a magnet gap and a coil located at least partially within the gap, the coil being connected to the diaphragm.

* * * * *